US011965285B2

(12) United States Patent
Wang

(10) Patent No.: US 11,965,285 B2
(45) Date of Patent: Apr. 23, 2024

(54) METHOD FOR MANUFACTURING LEATHER ARTICLE

(71) Applicant: Chaei Hsin Enterprise Co., Ltd., Taichung (TW)

(72) Inventor: Shui-Mu Wang, Taichung (TW)

(73) Assignee: Chaei Hsin Enterprise Co., Ltd., Taichung (TW)

( * ) Notice: Subject to any disclaimer, the term of this patent is extended or adjusted under 35 U.S.C. 154(b) by 91 days.

(21) Appl. No.: 17/855,808

(22) Filed: Jul. 1, 2022

(65) Prior Publication Data

US 2023/0279611 A1 Sep. 7, 2023

(30) Foreign Application Priority Data

Mar. 3, 2022 (TW) ..... 111107661

(51) Int. Cl.
*D06N 3/00* (2006.01)
*D06N 3/18* (2006.01)

(52) U.S. Cl.
CPC ..... *D06N 3/0077* (2013.01); *D06N 3/18* (2013.01); *D06N 2205/10* (2013.01); *D06N 2211/28* (2013.01)

(58) Field of Classification Search
CPC ... D06N 2211/28; D06N 3/0077; B32B 37/10
USPC ..... 28/122; 264/510; 69/48
See application file for complete search history.

(56) References Cited

U.S. PATENT DOCUMENTS 2,970,345 A * 2/1961 Wangner, Jr. ..... D06N 3/0054 101/23
3,652,747 A * 3/1972 Shirota ..... D06N 3/0095 521/65
4,581,261 A 4/1986 Schaefer
4,751,116 A * 6/1988 Schaefer ..... B29C 43/18 428/521
6,733,864 B1 5/2004 Kubota
8,679,278 B2 * 3/2014 Jokisch ..... B32B 9/025 156/500
2004/0151852 A1 * 8/2004 Gauthier ..... B32B 37/10 428/35.6
2007/0095470 A1 * 5/2007 Gauthier ..... B32B 7/06 156/289
2011/0073245 A1 * 3/2011 Gauthier ..... B44F 9/12 156/247

(Continued)

FOREIGN PATENT DOCUMENTS

CN 206666907 U 11/2017
CN 110130118 A 8/2019

(Continued)

*Primary Examiner* — Jillian K Pierorazio
(74) *Attorney, Agent, or Firm* — Winston Hsu

(57) ABSTRACT

A method for manufacturing a leather article including a flexible leather includes steps as follows. A leather precursor is provided, wherein the leather precursor includes a polymer material. A release member, the leather precursor and a pressing member are stacked in sequence to form a stacked set, wherein at least one of the release member and the pressing member is formed with a plurality of vents. The stacked set is heated and vacuumized to allow the polymer material to form the flexible leather, such that the leather precursor forms the leather article. The leather article is separated from the release member and the pressing member.

20 Claims, 10 Drawing Sheets

(56) References Cited

U.S. PATENT DOCUMENTS

| | | | | |
|---|---|---|---|---|
| 2015/0183137 | A1 | 7/2015 | Rock | |
| 2015/0306865 | A1* | 10/2015 | Ozaki | B41F 16/0046 101/217 |
| 2016/0215174 | A1* | 7/2016 | He | C09J 7/25 |
| 2020/0208229 | A1* | 7/2020 | Mamat | D06P 5/08 |
| 2022/0009198 | A1* | 1/2022 | Dodworth | B32B 27/26 |
| 2022/0040946 | A1* | 2/2022 | Schaefer | B32B 5/32 |
| 2022/0243292 | A1* | 8/2022 | Ujiie | C14C 9/02 |

FOREIGN PATENT DOCUMENTS

| | | | | |
|---|---|---|---|---|
| CN | 209397416 | U | 9/2019 | |
| EP | 3 098 327 | A1 | 11/2016 | |
| EP | 3098327 | A1 * | 11/2016 | A43B 23/0215 |
| EP | 3 338 581 | A1 | 6/2018 | |
| JP | 60-224880 | A | 11/1985 | |
| JP | 2-234986 | A | 9/1990 | |
| JP | 2000-908 | A | 1/2000 | |
| TW | 1583617 | B | 5/2017 | |
| WO | 2009/145089 | A1 | 12/2009 | |

* cited by examiner

METHOD FOR MANUFACTURING LEATHER ARTICLE

BACKGROUND OF THE INVENTION

1. Field of the Invention

The present disclosure relates to a method for manufacturing a leather article, and more particularly, to a method for manufacturing a leather article which can avoid formation of air cells.

2. Description of the Prior Art

Artificial leathers are widely used in daily life due to advantages of softness, light weight, waterproof, easy processing, low price, etc. In general, conventional artificial leather is manufactured as follows. A polymer material in solid state is mixed with an organic solvent and/or a dispersant to form a liquid or paste mixture. The liquid or paste mixture is uniformly coated on a substrate, such as a fabric or a release paper. Then the substrate with the liquid or paste mixture is heated to remove the organic solvent and/or the dispersant therein and allow the polymer material to connect via thermal melt or crosslink to form a film-like or sheet-like artificial leather.

However, in the process of manufacturing the leather article, gas may be trapped by the polymer material resulting in forming air cells protruding from the leather article or pits left over from the air cells, which affects the quality and yield of the artificial leather. Accordingly, relevant manufactures are committed to improve the method for manufacturing the artificial leather.

SUMMARY OF THE INVENTION

According to one embodiment of the present disclosure, a method for manufacturing a leather article is disclosed. The leather article includes a flexible leather. The method for manufacturing the leather article includes steps as follows. A leather precursor is provided, wherein the leather precursor includes a polymer material. A release member, the leather precursor and a pressing member are stacked in sequence to form a stacked set, wherein at least one of the release member and the pressing member is formed with a plurality of vents. The stacked set is heated and vacuumized to allow the polymer material to form the flexible leather, such that the leather precursor forms the leather article. The leather article is separated from the release member and the pressing member.

According to another embodiment of the present disclosure, a method for manufacturing a leather article includes steps as follows. A leather precursor is provided, wherein the leather precursor includes a polymer material and a substrate. The leather precursor and a pressing member are stacked in sequence to form a stacked set, wherein the pressing member is formed with a plurality of vents. The stacked set is heated and vacuumized to allow the polymer material to combine with the substrate, such that the leather precursor forms the leather article. The leather article is separated from the pressing member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
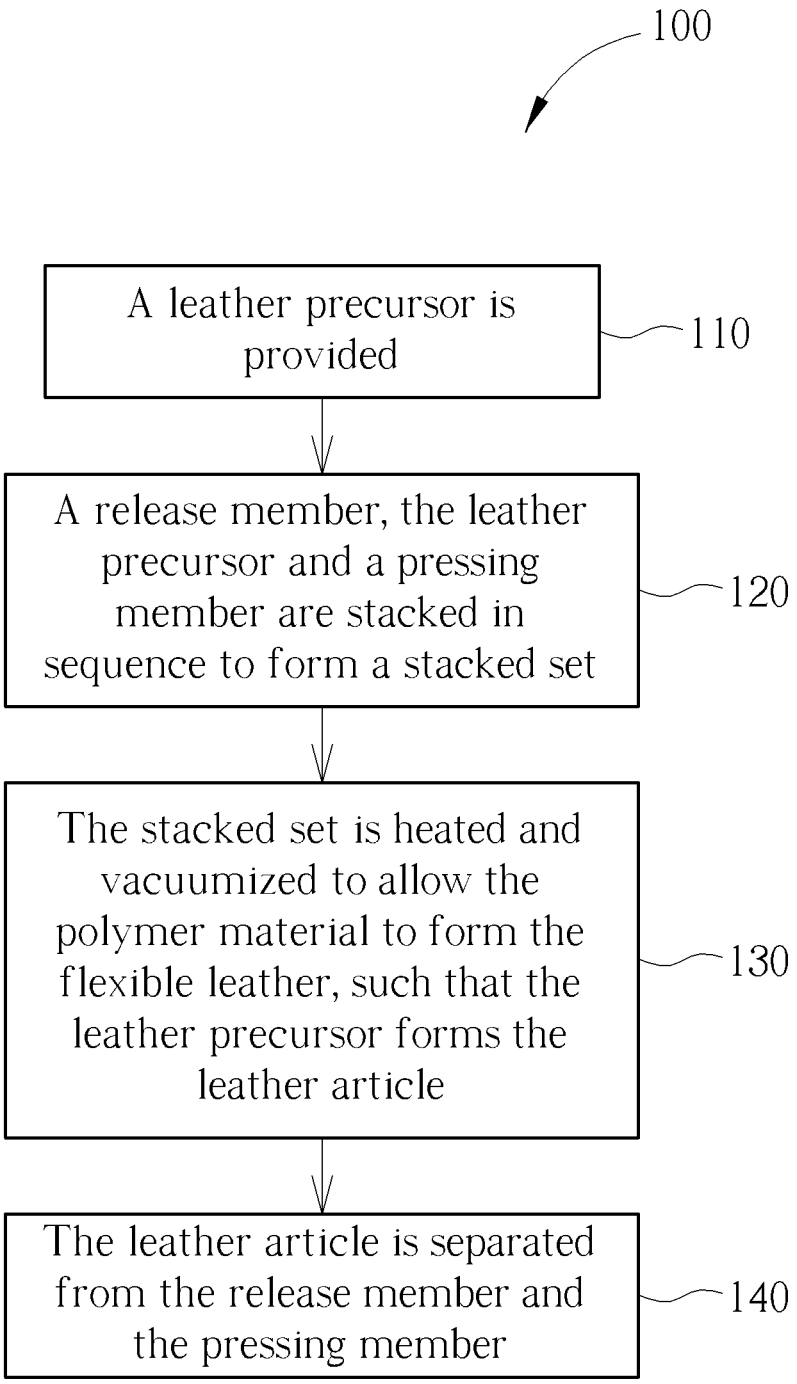
FIG. 1 is a flow diagram showing a method for manufacturing a leather article according to one embodiment of the present disclosure.

In order to enable the skilled persons in the art to better understand the present disclosure, hereinafter preferred embodiments with drawings are provided for illustrating the present disclosure and the effect to be achieved. It should be noted that the drawings are simplified schematic diagrams. Therefore, only elements related to the present disclosure and combination relationship thereof are shown to provide a clearer description of the basic framework or implementation methods of the present disclosure. The actual elements and configuration may be more complicated. In addition, for the sake of convenience, the number of the components in the drawings could be unequal to the actual number thereof, the shape and size of the components may not draw in proportion to the actual shape and size, and the proportion thereof may be adjusted according to design requirements.

The directional terminology in the following embodiments, such as top, bottom, left, right, front or back, is used with reference to the orientation of the Figure(s) being described. As such, the directional terminology is used for purposes of illustration and is in no way limiting. Furthermore, some drawings of the present disclosure are illustrated based on an XYZ rectangular coordinate system for ease of explanation.

According to the present disclosure, vents are provided for exhausting gas from a stacked set. For example, the vents are provided for exhausting air between a leather precursor and a pressing member and/or air between the leather precursor and a release member. The vents may be formed on a side surface of the release member and/or the pressing member.

According to the present disclosure, by heating and vacuumizing a stacked set, a polymer material is allowed to form a flexible leather. According to the material of the polymer material, the polymer material can form the flexible leather through physical melting connection or chemical crosslink.

According to the present disclosure, a method for manufacturing a leather article may be a continuous process or a discontinuous process. The continuous process may be carried out with equipment having a conveyor, which is beneficial to roll the finished leather article into bundles. The discontinuous process can be used to manufacture a single piece of leather article, which is beneficial to stack the finished leather articles layer by layer. The continuous process and discontinuous process are well-known in the art, and will not be repeated herein.

Please refer to FIG. 1, which is a flow diagram showing a method 100 for manufacturing a leather article according to one embodiment of the present disclosure. The method 100 for manufacturing the leather article includes Steps 110 to 140. In Step 110, a leather precursor is provided, wherein the leather precursor includes a polymer material. In Step 120, a release member, the leather precursor and a pressing member are stacked in sequence to form a stacked set, wherein at least one of the release member and the pressing member is formed with a plurality of vents. In Step 130, the stacked set is heated and vacuumized to allow the polymer material to form the flexible leather, such that the leather precursor forms the leather article. In Step 140, the leather article is separated from the release member and the pressing member.

Figure 2A:
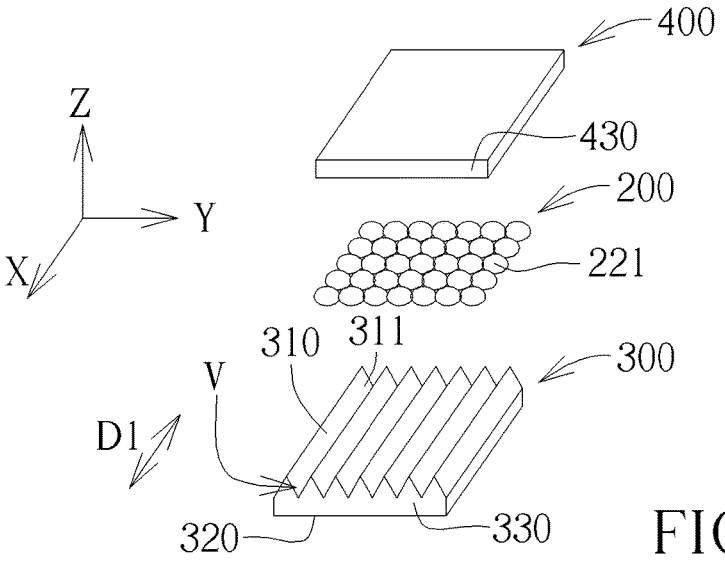
FIG. 2A, FIG. 2B, FIG. 2C and FIG. 2D aRE schematic diagrams showing steps of the method for manufacturing the leather article in FIG. 1.

Please further refer to FIG. 2A, FIG. 2B, FIG. 2C and FIG. 2D, which are schematic diagrams showing steps of the method 100 for manufacturing the leather article in FIG. 1. For clearly illustrating, the viewing angle of each step may be different. For the viewing angle of each step, reference may be made to the spatial direction defined by the XYZ rectangular coordinate system. First, as shown in FIG. 2A, a leather precursor 200 is provided. Herein, the leather precursor 200 only includes a polymer material. In other words, the leather precursor 200 is the polymer material. The polymer material is a plurality of polymer particles 221. According to one embodiment, a particle size of each of the polymer particles 221 may be greater than 0 μm and less than or equal to 500 μm. According to some embodiments, a thickness of the finished flexible leather may be adjusted by the particle sizes of the polymer particles 221. According to another embodiment, a particle size of each of the polymer particles 221 may be greater than 0 μm and less than or equal to 300 μm. In the embodiment, the polymer material only includes a single kind of polymer particles 221. That is, the polymer particles 221 have identical color and material, and have similar particle sizes. However, the present disclosure is not limited thereto. In other embodiments, the polymer material may include at least two kinds of polymer particles, details thereof may refer to relevant description of FIG. 7. Herein, the shape of the polymer material is granular, which is exemplary. In other embodiments, the polymer material may be formed in other shapes. For example, when the particle size of the polymer material is smaller, the polymer material may be in the form of powders. As another example, the polymer material may be in the form of sheet, wherein the sheet may be a flake having a smaller size or a sheet material having a larger size (see polymer sheets 221*b*-224*b* shown in FIG. 8). The polymer material may be made of thermoplastic resin, thermoset resin or synthetic rubber. For example, the polymer material may be made of thermoplastic polyurethanes (TPU). As such, the leather article 600 can be featured with excellent wear resistance and plasticity.

Figure 2B:
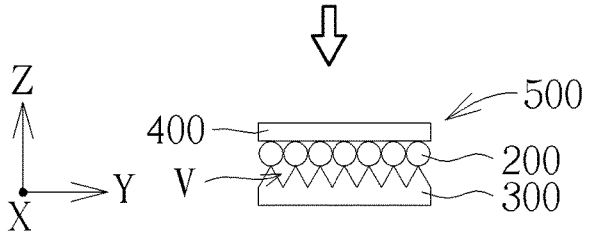

Next, as shown in FIG. 2B, the release member 300, the leather precursor 200 and the pressing member 400 are stacked in sequence from bottom to top to form a stacked set 500. The release member 300 and the pressing member 400 may independently be a soft piece or a hard piece. For example, the soft piece may be a flexible and bendable sheet, and the hard piece may be a rigid and unbending plate. In the embodiment, the release member 300 is formed with a plurality of vents V, such as the vents V shown in FIG. 3. For example, a surface of the release member 300 facing toward the leather precursor 200 is concaved to form a plurality of grooves 310, and the plurality of vents V are formed at ends 311 of the grooves 310. In some embodiments, the plurality of grooves 310 may present a specific pattern or texture. The pressing member 400 may include an airtight material. For example, the pressing member 400 may be entirely made of an airtight material so as to form an airtight layer. Alternatively, the pressing member 400 may include an airtight layer disposed adjacent to or apart from the leather precursor 200, such as the airtight layer 420*a* shown in FIG. 4, the airtight layer 420*b* shown in FIG. 5, and the airtight layer 420*b*' shown in FIG. 6.

Figure 2C:
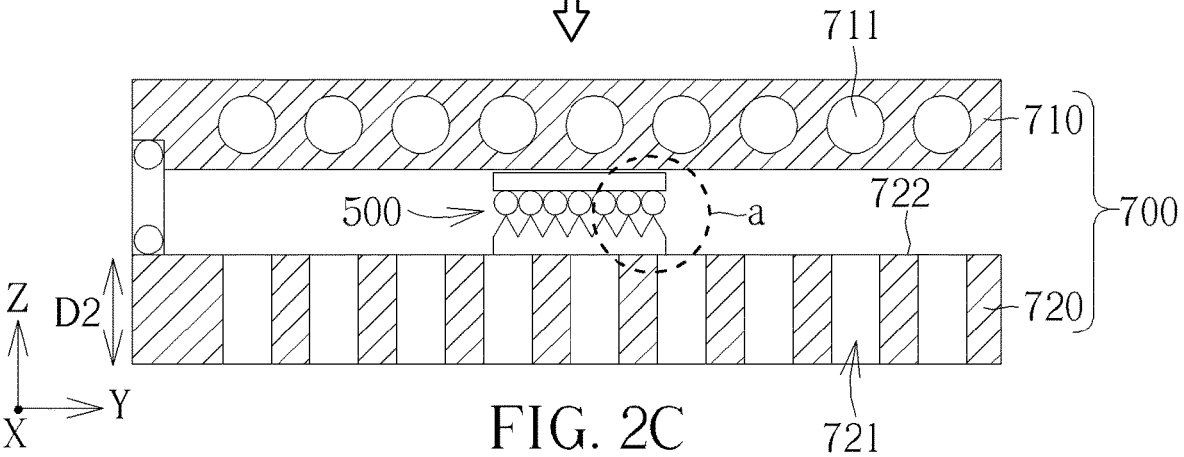

Afterwards, as shown in FIG. 2C, the stacked set 500 is placed into an apparatus 700. The apparatus 700 includes a heat pressing module 710 and a vacuum module 720. The heat pressing module 710 includes a plurality of heating units 711. The heat pressing module 710 is used for heating the stacked set 500. The vacuum module 720 includes a plurality of gas flow channels 721. The vacuum module 720 is used for vacuumizing or evacuating gas from the stacked set 500. In order to illustrate the flow direction of the gas, the apparatus 700 is presented in cross-section, so as to show the heating units 711 and the gas flow channels 721 disposed therein; the stacked set 500 is presented in end surface, so as show a side surface 430 of the pressing member 400 and a side surface 330 of the release member 300. In addition, an area of an upper surface 722 of the vacuum module 720 is larger than an area of a lower surface 320 of the release member 300, so that at least one of the gas flow channels 721 is not covered by the release member 300. Therefore, it is beneficial for the gas in the stacked set 500 to flow through the side surface 330 of the release member 300 to the gas flow channel 721 which is not covered by the release member 300, so that the stacked set 500 can be vacuumized.

Figure 2D:
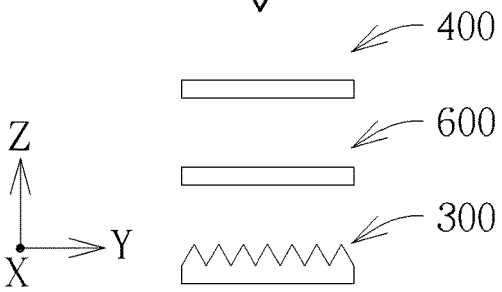

By vacuumizing the stacked set 500, it enables the pressing member 400 to apply a pressure to the leather precursor 200, which is beneficial to lower the melting point of the leather precursor 200, so as to lower the process temperature. Next, the stacked set 500 is heated and vacuumized to allow the polymer material to form a flexible leather, such that the leather precursor 200 forms the leather article 600. According to one embodiment of the present disclosure, heating and vacuumizing the stacked set 500 may be conducted under the following conditions: the heating temperature is in the range of 80° C. to 250° C., the heating duration is less than or equal to 180 seconds, and the pressure applied by the pressing member 400 to the leather precursor 200 is greater than 0 bar and less than or equal to 5 bar. According to another embodiment of the present disclosure, heating and vacuumizing the stacked set 500 may be conducted under the following conditions: the heating temperature is in the range of 140° C. to 200° C., the heating duration is 90 seconds to 180 seconds, and the pressure applied by the pressing member 400 to the leather precursor 200 is in the range of 1 bar to 2 bar. In the embodiment, since the leather precursor 200 only includes the polymer material, the flexible leather formed by the polymer material is the leather article 600. At last, as shown in FIG. 2D, the leather article 600 is separated from the release member 300 and the pressing member 400, so as to complete the manufacture of the leather article 600.

Figure 3:
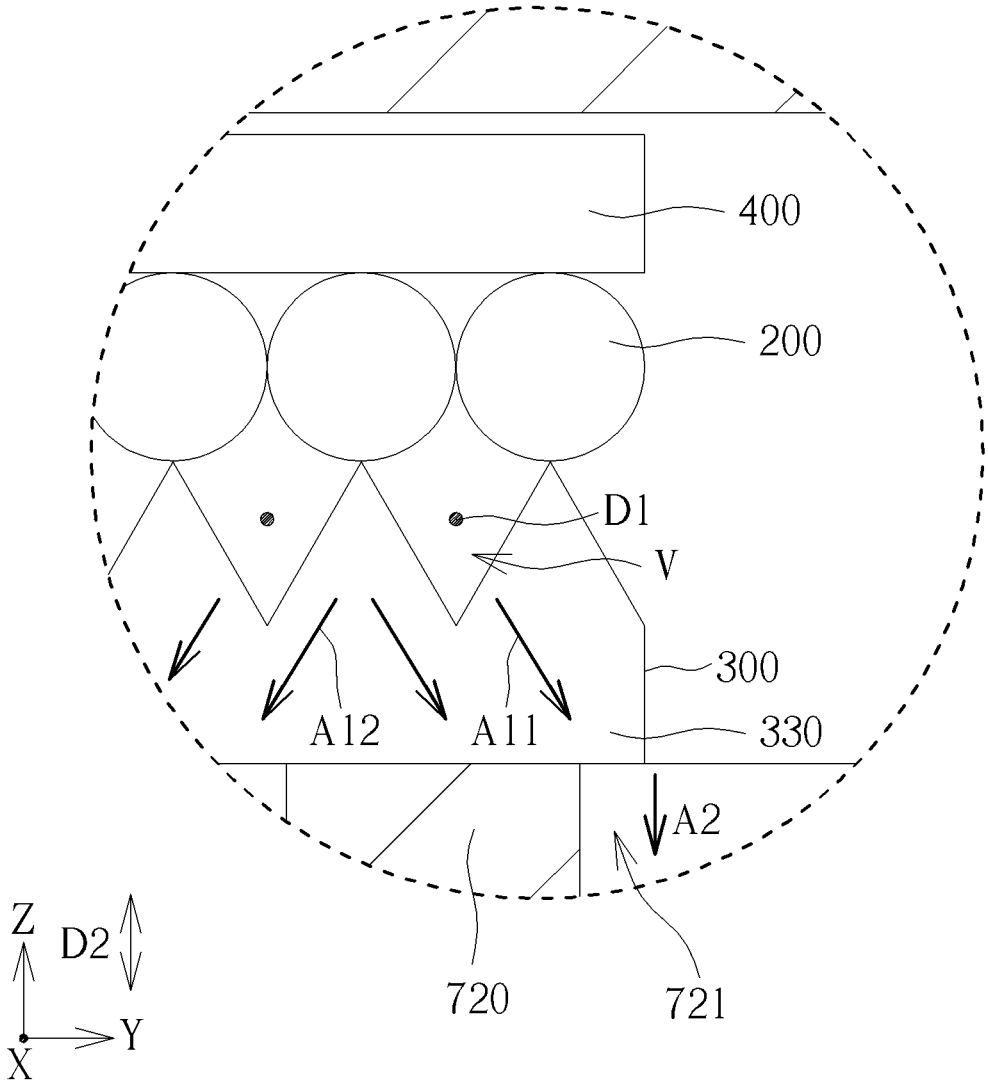
FIG. 3 is an enlarged view of a portion a of FIG. 2

Please refer to FIG. 2 and FIG. 3. FIG. 3 is an enlarged view of a portion a of FIG. 2, wherein the X-axis is perpendicular to the paper surface, an extending direction D1 of the grooves 310 is parallel to the X-axis, and an extending direction D2 of the gas flow channels 721 of the vacuum module 720 is parallel to the Z-axis. When the stacked set 500 is heated and vacuumized by the apparatus 700, the gas such as air within the stacked set 500 would first flow along the extending direction D1 of the grooves 310 and leave the grooves 310 through the vents V. Then the gas would flow down the side surface 330 of the release member 300, such as flowing along the directions of arrows A11 and A12, and finally flows into the gas flow channels 721 being evacuated away along the direction of arrow A2. By evacuating the gas within the stacked set 500, it can prevent the gas from being trapped in the melted polymer material and forming air cells. Accordingly, it prevents surface unevenness of the finished flexible leather. While the surface of the flexible leather is uneven, it is unfavorable for the flexible leather to adhere to other articles, which makes the subsequent process difficult to access. Moreover, the flexible leather with air cells tends to break, leading to insufficient tensile strength and decreased yield. According to the method of the present disclosure, the leather precursor can be a solid material. That is, it does not need to form a liquid or paste mixture by using an organic solvent or dispersant, which can effectively reduce intermediate products (such as toxic gases) and is beneficial to environment protection. Moreover, by utilizing the method of the present disclosure, the process of leather articles can be simplified, and the costs of raw materials and environmental safety can be quite reduced.

In other embodiments, the pressing member 400 may be integrated with the heating units 711 (not shown). As such, the pressing member 400 can replace the heat pressing module 710 to heat the stacked set 500 directly. In this case, the apparatus 700 does not need the heat pressing module 710.

In other embodiments, the position of the release member 300 may be exchanged with that of the pressing member 400. For example, the pressing member 400 in FIG. 2 could be arranged as the pressing member 400*c* as shown in FIG. 10. In this case, a surface of the pressing member 400 facing toward the leather precursor 200 is formed with a plurality of grooves (similar to the release member 300 in FIG. 2). That is, the pressing member 400 is formed with the plurality of vents V instead of the release member 300.

In other embodiments, the pressing member 400 may be arranged to have a same structure with the release member 300. For example, the pressing member 400 may be arranged to have a structure similar to that of the pressing member 400*c* in FIG. 10, and the release member 300 may be arranged to have a structure similar to that of the release member 300 in FIG. 2. In this case, surfaces of the pressing member 400 and the release member 300 facing toward the leather precursor 200 are both formed with pluralities of grooves. That is, both the pressing member 400 and the release member 300 are formed with the plurality of vents V. As a result, the efficiency of evacuating the gas within the stacked set 500 can be further improved.

Figure 4A:
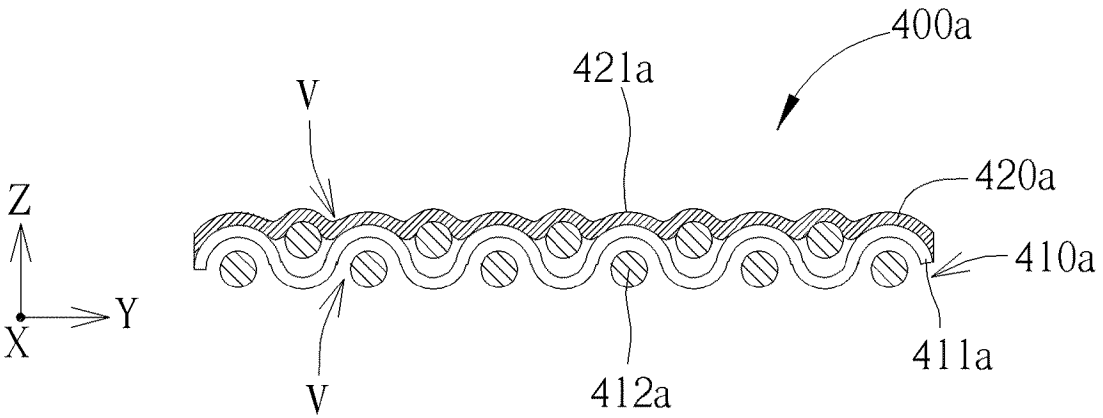
FIG. 4A, FIG. 4B, and FIG. 4C are schematic cross-sectional views of a pressing member and stacked sets according to another embodiment of the present disclosure.
Figure 4B:
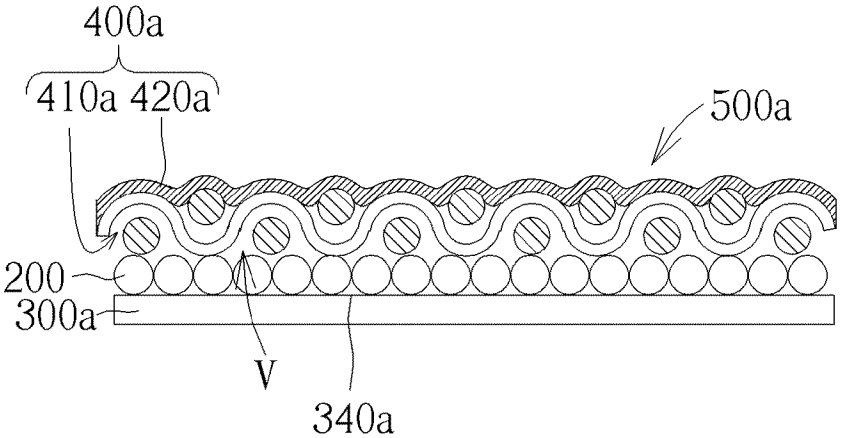
Figure 4C:
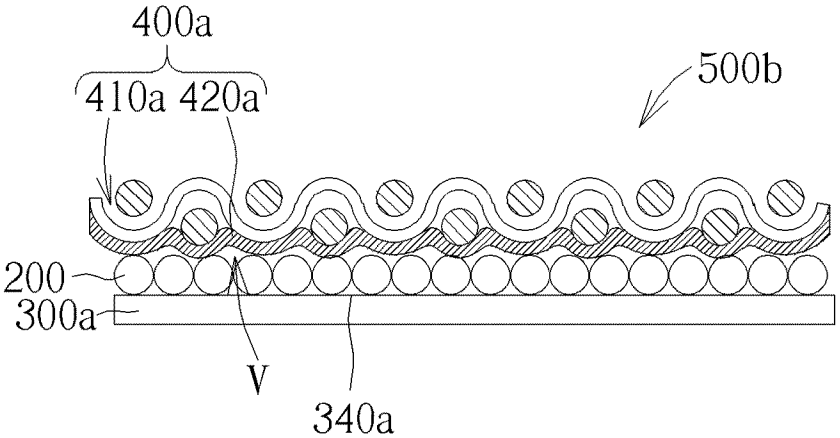

Please refer to FIG. 4A, FIG. 4B, and FIG. 4C, which are schematic cross-sectional view of a pressing member 400*a* and stacked sets 500*a*, 500*b* according to another embodiment of the present disclosure. As shown in FIG. 4A, the pressing member 400*a* includes an air-permeable layer 410*a* and an airtight layer 420*a*. Specifically, the air-permeable layer 410*a* may be a heat resistant fiber fabric, and the heat resistant fiber fabric may be, but not limited to, synthetic fiber fabric, woven fabric, knitted fabric, non-woven fabric, etc. The aforementioned "heat resistant fiber fabric" refers to a fiber fabric that will not react with the leather precursor/leather article or not melt at the temperature of Step 130 (see FIG. 1), so it won't contaminate the leather precursor/leather article. In the embodiment, the heat resistant fiber fabric includes weft yarns 411*a* and warp yarns 412*a*, and the heat resistant fiber fabric has air permeability due to gaps (not labeled) between the weft yarns 411*a* and the warp yarns 412*a*. The air-permeable layer 410*a* and the airtight layer 420*a* are connected with each other. For example, the airtight layer 420*a* may be made of glue material, and the airtight layer 420*a* may be a glue film adhered to the air-permeable layer 410*a* by coating or infiltration. Since the glue film is compliant and can reflect the surface undulation of the air-permeable layer 410*a*, the airtight layer 420*a* can have an uneven surface 421*a*, and the concave spaces communicating with each other on the surface 421*a* can serve as grooves for gas to flow. In other words, the surface 421*a* of the airtight layer 420*a* may concave to form a plurality of grooves due to the undulation of the air-permeable layer 410*a*, and a plurality of vents V are formed at ends of the plurality of grooves. In the embodiment, to form the stacked set 500*a*, the air-permeable layer 410*a* may be disposed adjacent to the leather precursor 200, and the airtight layer 420*a* may be disposed apart from the leather precursor 200. In this case, the air-permeable layer 410*a* is formed with the plurality of vents V, due to the gaps located at an end of the heat resistant fiber fabric, as shown in FIG. 4B. Alternatively, to form the stacked set 500*b*, the airtight layer 420*a* may be disposed adjacent to the leather precursor 200, and the air-permeable layer 410*a* may be disposed apart from the leather precursor 200. In this case, the airtight layer 420*a* is formed with the plurality of vents V, due to the concave spaces located at the end of the surface 421*a*. Accordingly, the vents V are similarly located at ends of the plurality of grooves, as shown in FIG. 4C.

Figure 5:
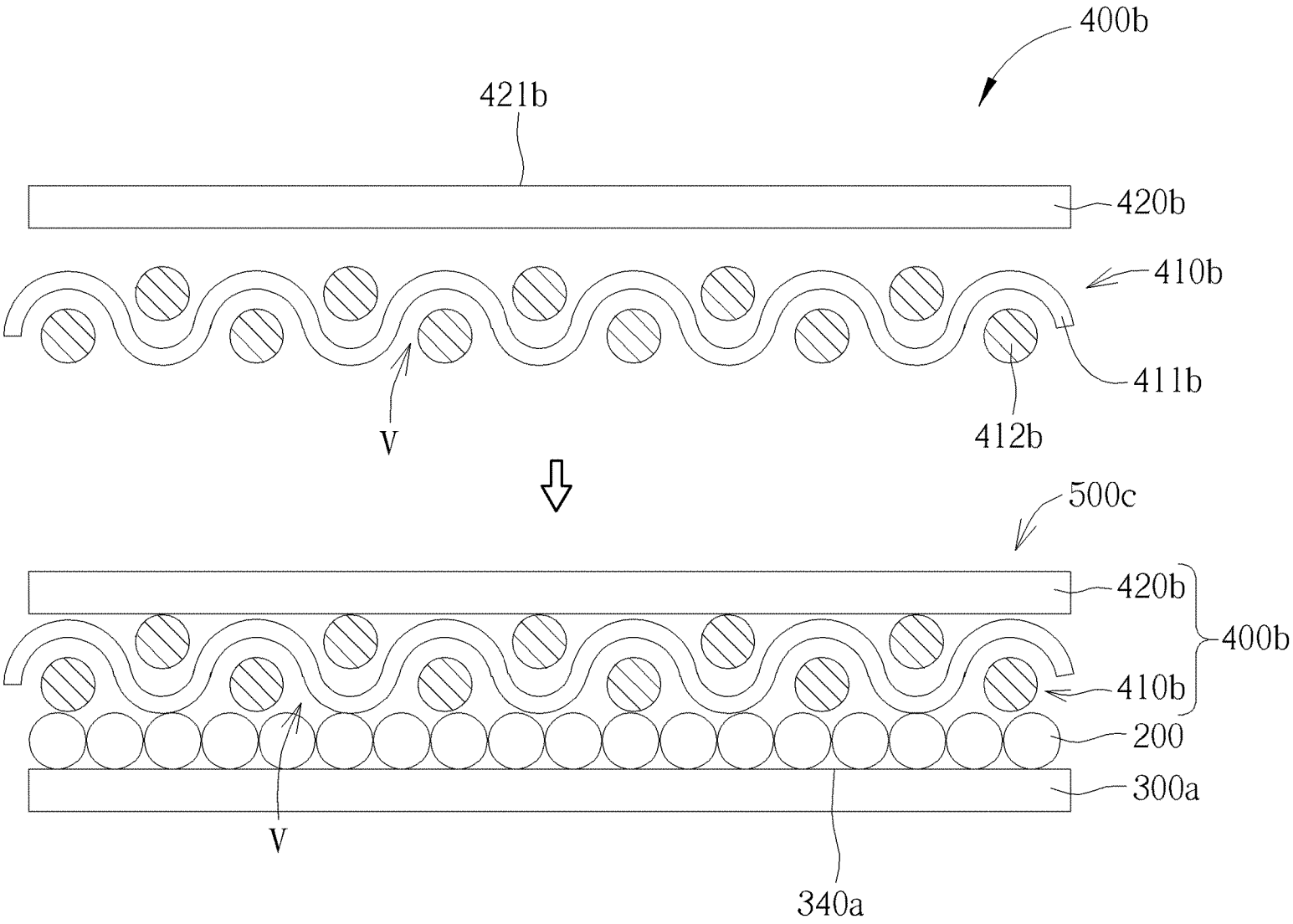
FIG. 5 is a schematic cross-sectional view of a pressing member and a stacked set according to further another embodiment of the present disclosure.
Figure 6:
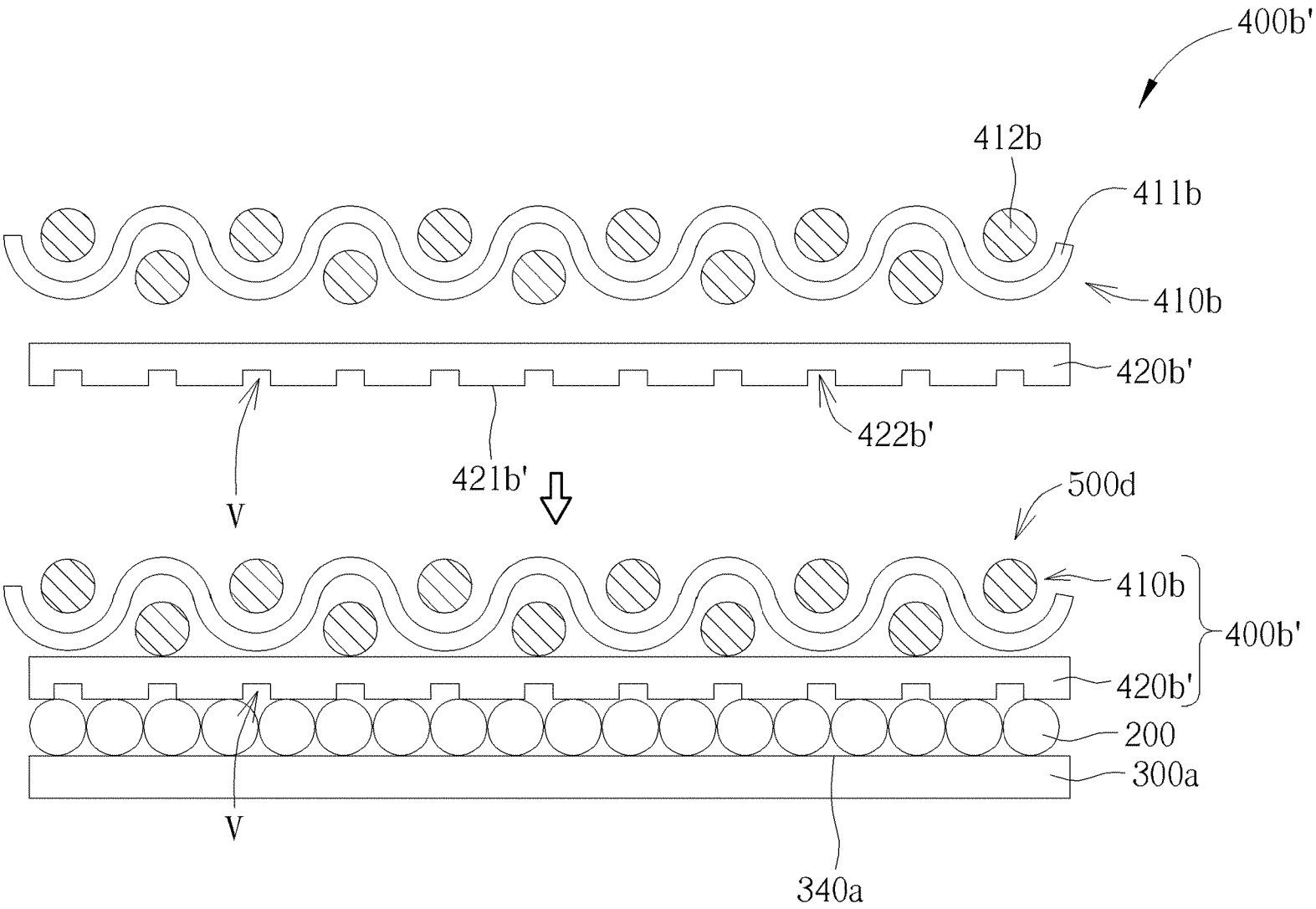
FIG. 6 is a schematic cross-sectional view of a pressing member and a stacked set according to yet another embodiment of the present disclosure.

Please refer to FIG. 5, which is a schematic cross-sectional view of a pressing member 400*b* and a stacked set 500*c* according to further another embodiment of the present disclosure. The pressing member 400*b* includes an air-permeable layer 410*b* and an airtight layer 420*b*. The air-permeable layer 410*b* may be a heat resistant fiber fabric. In the embodiment, the heat resistant fiber fabric includes weft yarns 411*b* and warp yarns 412*b*. In the embodiment, the airtight layer 420*b* may be made of silicone. The difference between the pressing member 400*b* and the pressing member 400*a* is that the air-permeable layer 410*b* and the airtight layer 420*b* are two independent components. That is, the air-permeable layer 410*b* and the airtight layer 420*b* are detachable and may not be fixed with each other through glue or other means. In the embodiment, to form the stacked set 500*c*, the air-permeable layer 410*b* may be disposed adjacent to the leather precursor 200 and the airtight layer 420*b* may be disposed apart from the leather precursor 200. In this case, only the air-permeable layer 410*b* is formed with the plurality of vents V. Please refer to FIG. 6, which is a schematic cross-sectional view of a pressing member 400*b*' and a stacked set 500*d* according to yet another embodiment of the present disclosure. The difference between FIG. 5 and FIG. 6 is that a surface 421*b*' of the airtight layer 420*b*' facing away from the air-permeable layer 410*b* is concaved to form a plurality of grooves 422*b*', and the plurality of vents V are formed at ends of the plurality of grooves 422*b*'. In this embodiment, to form the stacked set 500*d*, the airtight layer 420*b*' may be disposed adjacent to the leather precursor 200 and the surface 421*b*' formed with the plurality of grooves 422*b*' faces toward the leather precursor 200, and the air-permeable layer 410*b* may be disposed apart from the leather precursor 200. In some embodiments, the airtight layer 420*b*' may be made of plastic, which is convenient to form grooves 422*b*' on the surface 421*b*' of the airtight layer 420*b*'. In other embodiments, the airtight layer may be composed of several materials. For example, the airtight layer may be a composite structure formed by two of the following materials: plastic, silicone, rubber, glue material, etc.

In FIGS. 4, 5, and 6, a surface 340*a* of the release member 300*a* facing toward the leather precursor 200 is totally flat. That is, only the pressing members 400*a*, 400*b*, 400*b*' are formed with the plurality of vents V. However, in other embodiments, the release member 300*a* can be replaced by the release member 300 (see FIG. 2), such that the pressing members 400*a*, 400*b*, 400*b*' and the release member 300 are formed with the plurality of vents V simultaneously. Alternatively, the surface 340*a* of the release member 300*a* may be formed with special textures or designed patterns, so that the special textures or designed patterns can be imprinted on the leather article, allowing the leather article to demonstrate the desired visual effects.

Figure 7:
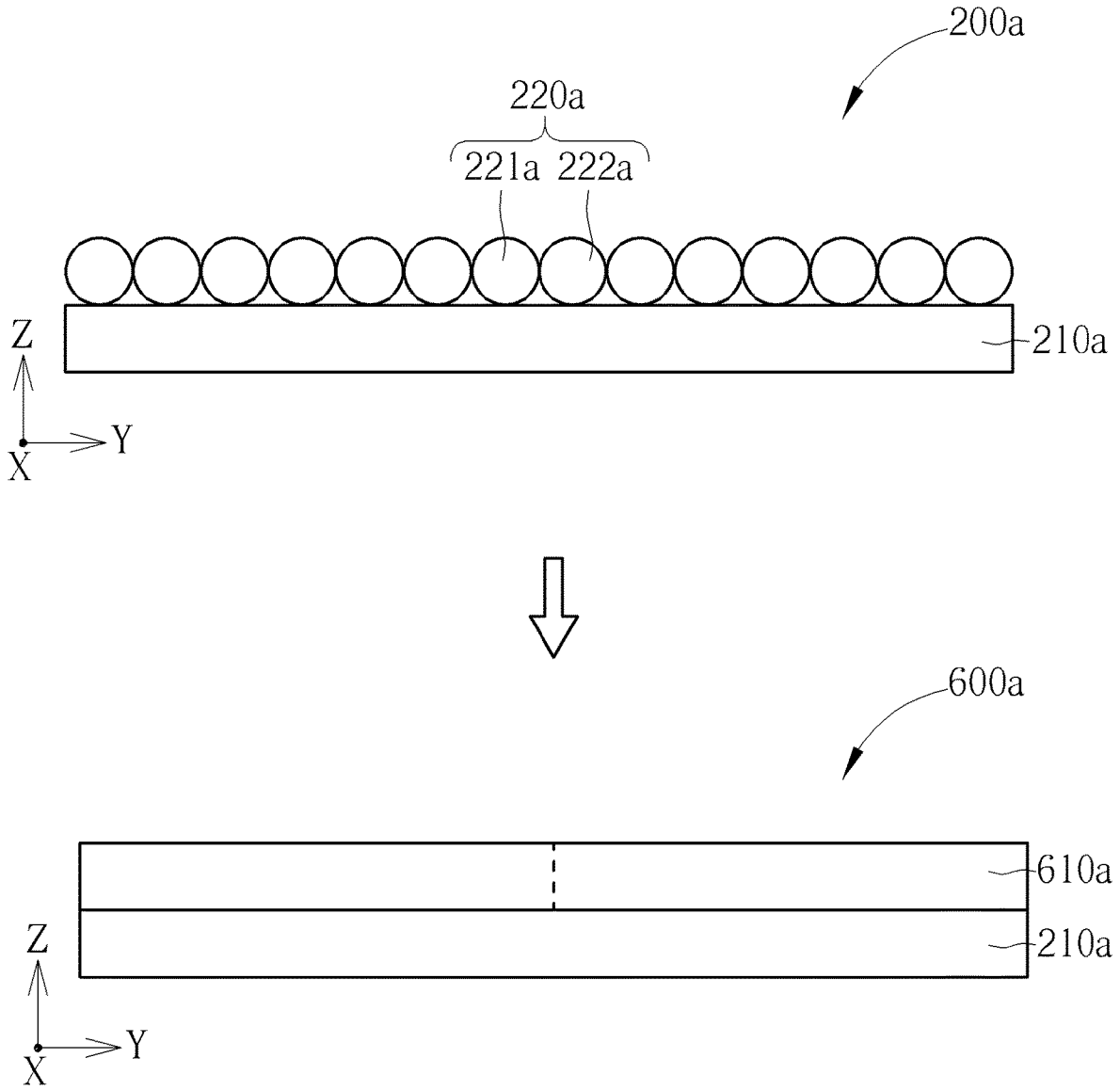
FIG. 7 is a schematic cross-sectional view of a leather precursor and a leather article according to another embodiment of the present disclosure.

Please refer to FIG. 7, which is a schematic cross-sectional view of a leather precursor 200*a* and a leather article 600*a* according to another embodiment of the present disclosure. The leather precursor 200*a* includes a polymer material 220*a* and a substrate 210*a*. In the embodiment, to form a stacked set, the substrate 210*a* may be disposed adjacent to a release member (not shown), and the polymer material 220*a* may be disposed adjacent to a pressing member (not shown). After step 130 (see FIG. 1), the leather precursor 200*a* can form the leather article 600*a*. In this case, the leather article 600*a* is a composite structure including the flexible leather 610*a* and the substrate 210*a*. Compared the leather article 600 (see FIG. 2) with the leather article 600*a*, the leather article 600 further requires additional steps to adhere the leather article 600 to other substrate for subsequent applications. In contrast, the leather article 600*a* has already contained the required substrate 210*a*, which is convenient for subsequent applications. Specifically, the polymer material 220*a* may include a plurality of polymer particles. The polymer particles may include at least one kind of polymer particles. Herein, the polymer particles include two kinds of polymer particles, i.e., a plurality of first polymer particles 221*a* and a plurality of second polymer particles 222*a*. As the polymer material 220*a* includes at least two kinds of polymer particles, each kind of the at least two kinds of polymer particles preferably has similar characteristic. For example, the at least two kinds of polymer particles are all thermoplastic polymer particles or all thermoset polymer particles. On the other hand, the at least two kinds of polymer particles may have different colors, different materials and/or different particle sizes. With a delicate arrangement, the leather article 600*a* may present an astonishing visual effect. In the example shown in FIG. 7, the first polymer particles 221*a* and the second polymer particles 222*a* have different colors, similar material characteristics, and similar particle sizes. After step 130 (see FIG. 1), the first polymer particles 221*a* and the second polymer particles 222*a* are both melted and then connect physically, so that a color of the left portion of the leather article 600*a* shown in FIG. 7 is different from a color of the right portion of the leather article 600*a*. As another example, the color and the material of the first polymer particles 221*a* are different from those of the second polymer particles 222*a*, but the particle size of the first polymer particles 221*a* is similar to that of the second polymer particles 222*a*. In this case, the melting temperature of the first polymer particles 221*a* is exemplarily higher than that of the second polymer particles 222*a*, and the first polymer particles 221*a* are scattered over the second polymer particles 222*a* which are arranged to be transparent or translucent. After Step 130 (see FIG. 1), the second polymer particles 222*a* with a lower melting temperature are completely melted and wrap the first polymer particles 221*a*. As such, another visual effect different from that of the leather article 600*a* can be provided. As further another example, the color and the particle size of the first polymer particles 221*a* are different from those of the second polymer particles 222*a*, yet the material of the first polymer particles 221*a* is the same as that of the second polymer particles 222*a*. In this case, the particle size of the first polymer particles 221*a* is exemplarily larger than that of the second polymer particles 222*a*, and the first polymer particles 221*a* are scattered over the second polymer particles 222*a*. After Step 130 (see FIG. 1), by adjusting the heating temperature and duration time of Step 130, each of the first polymer particles 221*a* is controlled to achieve that only the exterior portion thereof is melted but the interior portion not, and each of the second polymer particles 222*a* is completely melted. Since the melting proportion of each of the first polymer particles 221*a* (e.g., 50%) is different from that of each of the second polymer particles 222*a* (e.g., 100%), the leather article can provide further another visual effect different from that of the leather article 600*a*.

Figure 8:
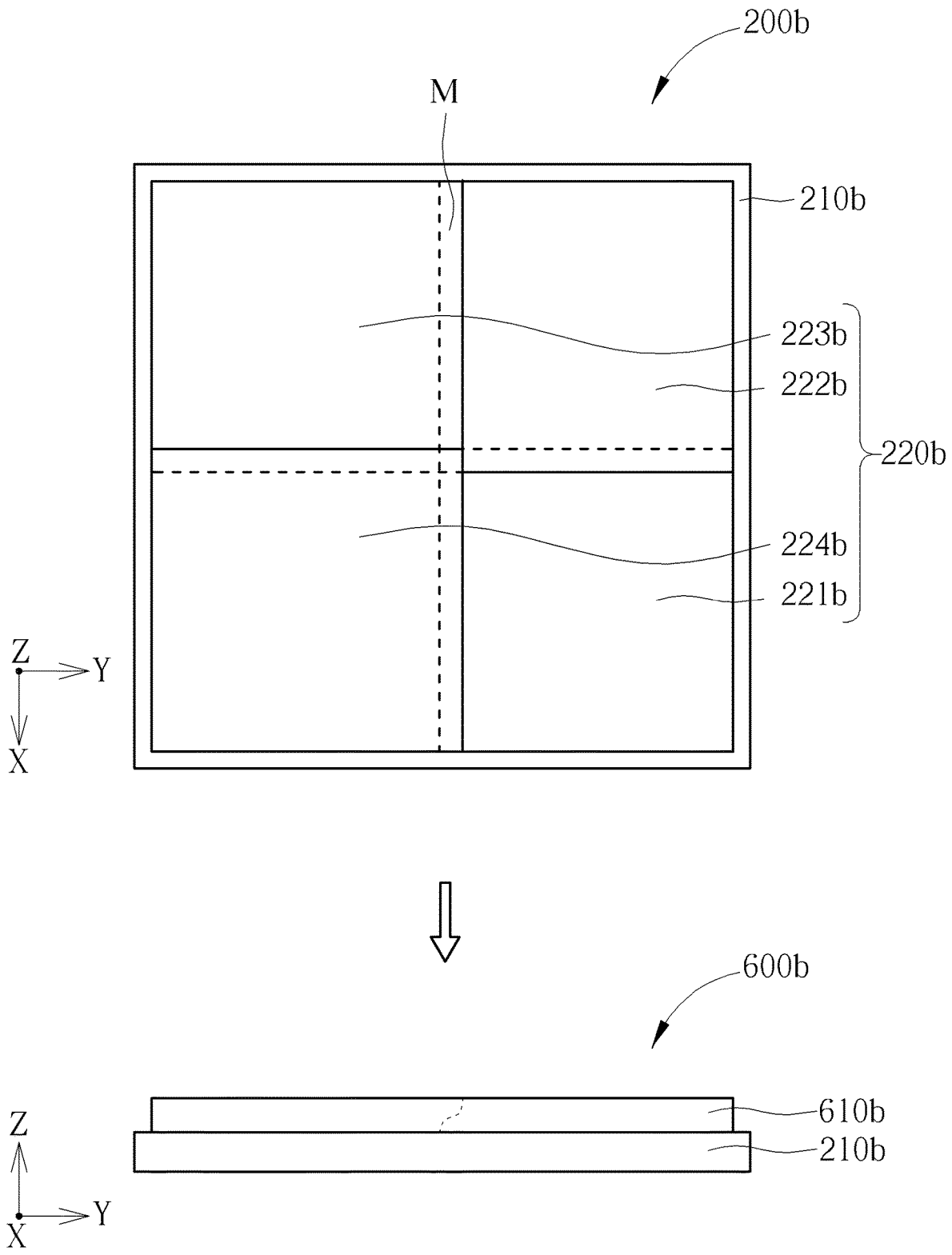
FIG. 8 is a schematic top view of a leather precursor and cross-sectional view of a leather article according to yet another embodiment of the present disclosure.

Please refer to FIG. 8, which is a schematic top view of a leather precursor 200*b* and cross-sectional view of a leather article 600*b* according to yet another embodiment of the present disclosure. The leather precursor 200*b* includes a polymer material 220*b* and a substrate 210*b*. After Step 130 (see FIG. 1), the leather precursor 200*b* forms the leather article 600*b*. In this case, the leather article 600*b* is a composite structure including the flexible leather 610*b* and the substrate 210*b*. In the embodiment, the polymer material 220*b* is a plurality of polymer sheets 221*b*-224*b*. Herein, the polymer sheets 221*b*-224*b* are rectangular sheets, which is exemplary. Several edge portions of the plurality of polymer sheets 221*b*-224*b* overlap with each other, forming overlapping regions M. After Step 130, the polymer sheets 221*b*-224*b* can be combined with each other through the overlapping regions M to form an integral flexible leather 610*b*. In the embodiment, the substrate 210*b* may be disposed adjacent to a release member (not shown) and the polymer material 220*b* may be disposed adjacent to a pressing member (not shown), or the polymer material 220*b* may be disposed adjacent to the release member and the substrate 210*b* may be disposed adjacent to the pressing member, depending on the needs of finished products. In some embodiments, each of the polymer sheets 221*b*-224*b* may be a flexible leather, and the flexible leather may be made of thermoplastic resin, thermoset resin or synthetic rubber. According to one embodiment of the present disclosure, the polymer sheets 221*b*-224*b* may be the flexible leathers manufactured by the steps as shown in FIG. 2. That is, when the leather precursor only includes the polymer material, the leather article is the flexible leather. As a result, the plurality of the flexible leathers with smaller areas are combined to form the flexible leather 610*b* with a larger area.

As shown in FIGS. 7 and 8, the substrates 210*a* and 210*b* may independently be a soft piece or a hard piece. For example, the soft piece may be a flexible and bendable sheet, film or fabric, and the hard piece may be a rigid and unbending plate or shell.

Figure 9:
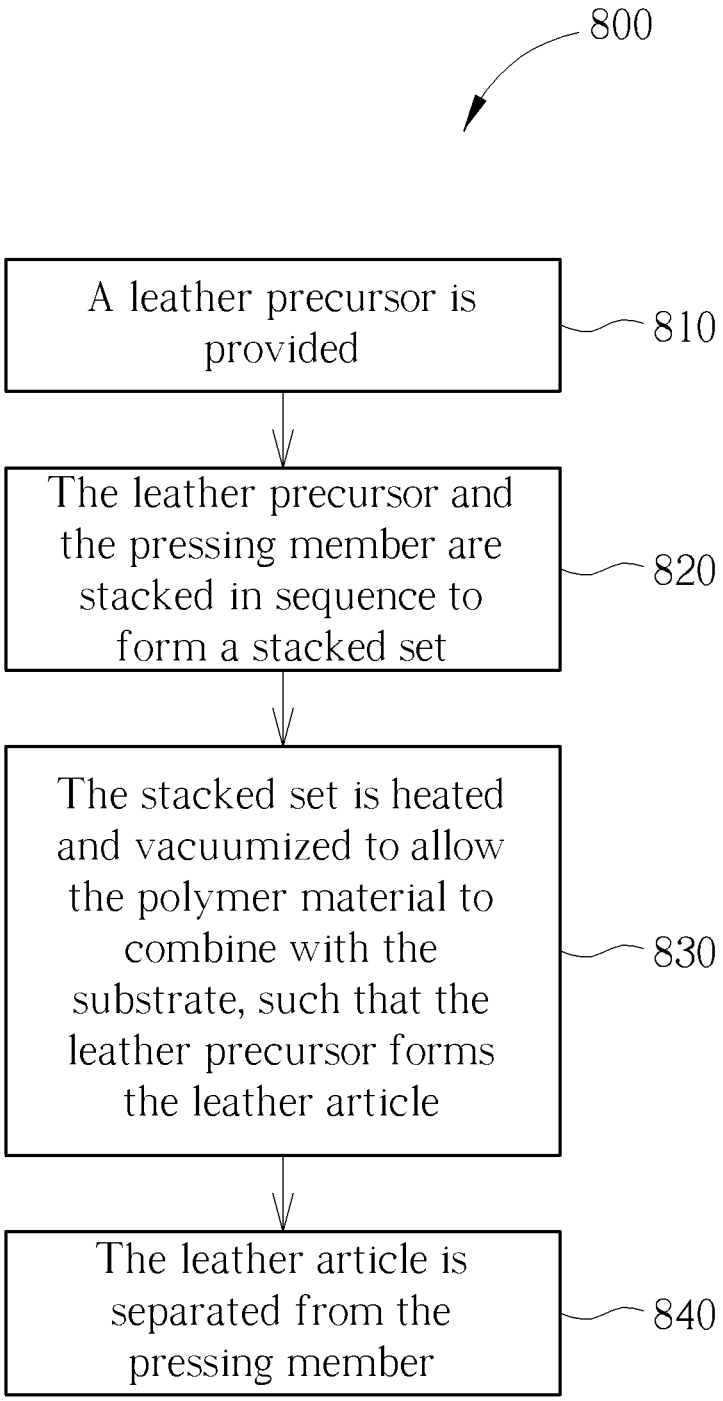
FIG. 9 is a flow diagram showing a method for manufacturing a leather article according to another embodiment of the present disclosure.

Please refer to FIG. 9, which is a flow diagram showing a method 800 for manufacturing a leather article according to another embodiment of the present disclosure. The method 800 for manufacturing the leather article includes Steps 810 to 840. In Step 810, a leather precursor is provided, wherein the leather precursor includes a polymer material and a substrate. In Step 820, the leather precursor and the pressing member are stacked in sequence to form a stacked set, wherein the pressing member is formed with a plurality of vents. In Step 830, the stacked set is heated and vacuumized to allow the polymer material to combine with the substrate, such that the leather precursor forms the leather article. In Step 840, the leather article is separated from the pressing member.

Figure 10A:
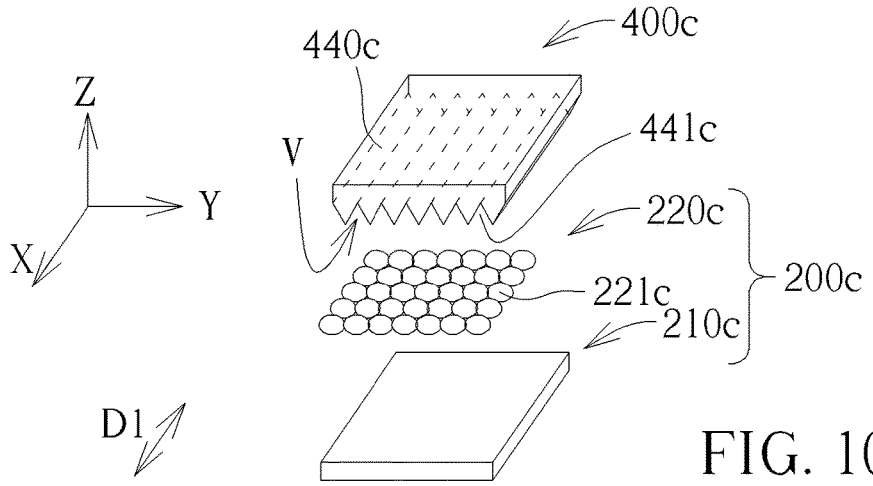
FIG. 10A, FIG. 10B, FIG. 10C and FIG. 10D are schematics diagram showing steps of the method for manufacturing the leather article in FIG. 9.

Please refer to FIG. 10A, FIG. 10B, FIG. 10C and FIG. 10D, which are schematic diagram showing steps of the method 800 for manufacturing the leather article in FIG. 9. For clearly illustrating, the viewing angle of each step may be different. For the viewing angle of each step, reference may be made to the spatial direction defined by the XYZ rectangular coordinate system. First, as shown in FIG. 10A, a leather precursor 200*c* is provided. The leather precursor 200*c* includes a polymer material 220*c* and a substrate 210*c*. Herein, the polymer material 220*c* only includes a single kind of polymer particles 221*c*, which is exemplary. For the related details of the polymer material 220*c* and the polymer particles 221*c*, reference may be made to the related description of polymer material and the polymer particles 221 as shown in FIG. 2. Furthermore, the leather precursor 200*c* can be replaced by a leather precursor similar to the leather precursor 200*a* as shown in FIG. 7 or the leather precursor 200*b* as shown in FIG. 8 according to practical needs.

Figure 10B:
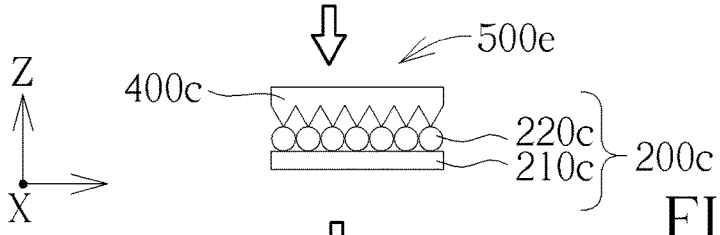

Next, as shown in FIG. 10B, the leather precursor 200*c* and the pressing member 400*c* are stacked in sequence from bottom to top to form a stacked set 500*e*. The pressing member 400*c* may be a soft piece or a hard piece. The pressing member 400*c* is formed with a plurality of vents V. For example, the pressing member 400*c* may include an airtight layer (not labeled). The airtight layer is disposed adjacent to the leather precursor 200*c*. A surface of the airtight layer facing toward the leather precursor 200*c* is concaved to form a plurality of grooves 440*c*, and the plurality of vents V are formed at ends 441*c* of the plurality of grooves 440*c*. In some embodiments, the plurality of grooves 440*c* may present a specific pattern or texture. In the embodiment, the pressing member 400*c* only includes the airtight layer. In other words, the pressing member 400*c* is formed by the airtight layer. In addition, the pressing member 400*c* may be replaced by a pressing member similar to the pressing member 400*a* as shown in FIG. 4, the pressing member 400*b* as shown in FIG. 5, or the pressing member 400*b*' as shown in FIG. 5 according to practical needs.

Figure 10C:
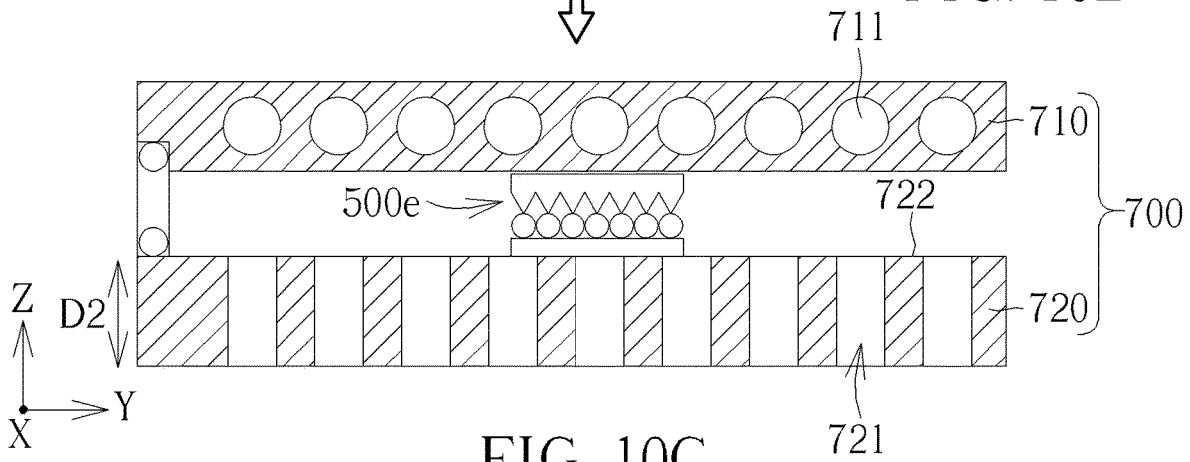
Figure 10D:
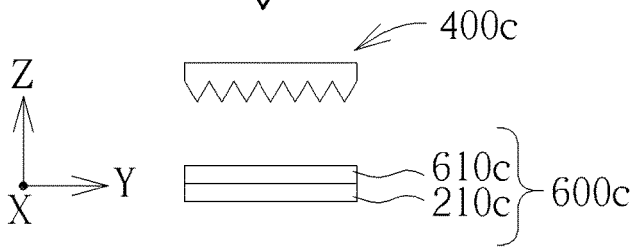

Afterwards, as shown in FIG. 10C, the stacked set 500*e* is placed into the apparatus 700. Next, the stacked set 500*e* is heated and vacuumized to allow the polymer material 220*c* to form the flexible leather 610*c*, such that the leather precursor 200*c* forms the leather article 600*c*. As last, as shown in FIG. 10D, the leather article 600*c* is separated from the pressing member 400*c*, so as to complete the manufacture of the leather article 600*c*.

Compared with the method 100 for manufacturing the leather article as shown in FIG. 1, the method 800 for manufacturing the leather article does not require a release member, which is beneficial to reduce the process procedure and the manufacturing cost of the leather article. In addition, the leather article 600*c* manufactured by the method 800 has already contained the substrate 210*c*, so the leather article 600*c* can be applied to subsequent process directly, which is favorable for the convenience of diverse applications.

Compared with the prior art, with the pressing member and/or the release member of the present disclosure formed with a plurality of vents and with vacuumizing the stacking set, it can prevent gas from being trapped by the polymer material during the melting or bonding process, and therefore avoids the formation of air cells protruding from the leather article or pits left over from the air cells. Accordingly, it is beneficial to improve the quality and production yield of leather articles.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for manufacturing a leather article, the leather article comprising a flexible leather, the method for manufacturing the leather article comprising:

providing a leather precursor, wherein the leather precursor comprises a polymer material;

stacking a release member, the leather precursor and a pressing member in sequence to form a stacked set, wherein at least one of the release member and the pressing member is formed with a plurality of vents;

heating and vacuumizing the stacked set to allow the polymer material to form the flexible leather, such that the leather precursor forms the leather article; and separating the leather article from the release member and the pressing member.

2. The method for manufacturing the leather article of claim 1, wherein the pressing member is formed with the plurality of vents.

3. The method for manufacturing the leather article of claim 1, wherein the pressing member comprises:

an air-permeable layer disposed adjacent to the leather precursor and formed with the plurality of vents; and an airtight layer disposed apart from the leather precursor.

4. The method for manufacturing the leather article of claim 3, wherein the air-permeable layer is made of heat resistant fiber fabric.

5. The method for manufacturing the leather article of claim 1, wherein the pressing member comprises:

an airtight layer disposed adjacent to the leather precursor, wherein a surface of the airtight layer facing toward the leather precursor is concaved to form a plurality of grooves, and the plurality of vents are formed at ends of the grooves.

6. The method for manufacturing the leather article of claim 5, wherein the airtight layer is made of plastic, silicone, rubber, glue material or a combination thereof.

7. The method for manufacturing the leather article of claim 1, wherein the release member is formed with the plurality of vents.

8. The method for manufacturing the leather article of claim 1, wherein a surface of the release member facing toward the leather precursor is concaved to form a plurality of grooves, and the plurality of vents are formed at ends of the grooves.

9. The method for manufacturing the leather article of claim 1, wherein the polymer material is a plurality of polymer particles, and a particle size of each of the polymer particles is greater than 0 μm and less than or equal to 500 μm.

10. The method for manufacturing the leather article of claim 9, wherein the plurality of polymer particles comprises a plurality of first polymer particles and a plurality of second polymer particles.

11. The method for manufacturing the leather article of claim 1, wherein heating and vacuumizing the stacked set is conducted at a temperature of 80° C. to 250° C. while vacuumizing the stacked set, such that a pressure of greater than 0 bar and less than or equal to 5 bar is applied to the leather precursor by the pressing member.

12. The method for manufacturing the leather article of claim 1, wherein the leather precursor further comprises a substrate, and the leather article is a composite structure comprising the flexible leather and the substrate.

13. The method for manufacturing the leather article of claim 12, wherein in the stacked set, the polymer material is disposed adjacent to the release member, and the substrate is disposed adjacent to the pressing member.

14. A method for manufacturing a leather article, comprising:

providing a leather precursor, wherein the leather precursor comprises a polymer material and a substrate;

stacking the leather precursor and a pressing member in sequence to form a stacked set, wherein the pressing member is formed with a plurality of vents;

heating and vacuumizing the stacked set to allow the polymer material to combine with the substrate, such that the leather precursor forms the leather article; and separating the leather article from the pressing member.

15. The method for manufacturing the leather article of claim 14, wherein the pressing member comprises:

an air-permeable layer disposed adjacent to the leather precursor and formed with the plurality of vents; and an airtight layer disposed apart from the leather precursor.

16. The method for manufacturing the leather article of claim 14, wherein the pressing member comprises:

an airtight layer disposed adjacent to the leather precursor, wherein a surface of the airtight layer facing toward the leather precursor is concaved to form a plurality of grooves, and the plurality of vents are formed at ends of the grooves.

17. The method for manufacturing the leather article of claim 14, wherein the polymer material is a plurality of polymer particles, and a particle size of each of the polymer particles is greater than 0 μm and less than or equal to 500 μm.

18. The method for manufacturing the leather article of claim 17, wherein heating and vacuumizing the stacked set is to allow the plurality of polymer particles to form a flexible leather and combine with the substrate, such that the leather precursor forms the leather article.

19. The method for manufacturing the leather article of claim 14, wherein the polymer material is a flexible leather, and the flexible leather is made of thermoplastic resin, thermoset resin or synthetic rubber.

20. The method for manufacturing the leather article of claim 14, wherein heating and vacuumizing the stacked set is conducted at a temperature of 80° C. to 250° C. while vacuumizing the stacked set, such that a pressure of greater than 0 bar and less than or equal to 5 bar is applied to the leather precursor by the pressing member.

* * * * *